US010674568B2

(12) United States Patent
Noda et al.

(10) Patent No.: US 10,674,568 B2
(45) Date of Patent: Jun. 2, 2020

(54) HEATING COOKER

(71) Applicant: Panasonic Intellectual Property Management Co., Ltd., Osaka (JP)

(72) Inventors: Keiko Noda, Osaka (JP); Hirohisa Imai, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 269 days.

(21) Appl. No.: 15/575,185

(22) PCT Filed: Jun. 1, 2016

(86) PCT No.: PCT/JP2016/002641
§ 371 (c)(1),
(2) Date: Nov. 17, 2017

(87) PCT Pub. No.: WO2016/199378
PCT Pub. Date: Dec. 15, 2016

(65) Prior Publication Data

US 2018/0152995 A1 May 31, 2018

(30) Foreign Application Priority Data

Jun. 12, 2015 (JP) ..... 2015-118818

(51) Int. Cl.
*H05B 6/64* (2006.01)
*F24C 7/08* (2006.01)
*H05B 6/80* (2006.01)

(52) U.S. Cl.
CPC ..... *H05B 6/6435* (2013.01); *F24C 7/085* (2013.01); *H05B 6/6444* (2013.01);
(Continued)

(58) Field of Classification Search
CPC ..... H05B 6/6438; H05B 6/6435
(Continued)

(56) References Cited

U.S. PATENT DOCUMENTS

2013/0306627 A1 11/2013 Libman et al.
2016/0283822 A1 9/2016 Imai et al.

FOREIGN PATENT DOCUMENTS

JP 2002-243166 8/2002
JP 2003-067747 3/2003
(Continued)

OTHER PUBLICATIONS

Translation of JP2005-140418 (Year: 2005).*
(Continued)

*Primary Examiner* — Lauren A Crane
(74) *Attorney, Agent, or Firm* — Brinks Gilson & Lione

(57) ABSTRACT

Provided are a heating unit, an imaging unit that captures an image of an interior of a heating chamber, a setting unit that sets heating control details, and a storage that registers the captured image and the set heating control details in association with each other. Further provided area plural-article determination unit that determines whether a plurality of types of foods are present, a similarity determination unit that determines a degree of similarity of a plurality of images, a control detail identification unit that identifies heating control details corresponding to a food included in a captured image in accordance with a determination result obtained by the similarity determination unit, and a controller. The controller presents heating control details indicating each food on a display unit in accordance with a number of the foods. This configuration can provide a heating cooker capable of facilitating heating control setting.

9 Claims, 7 Drawing Sheets

(52) U.S. Cl.
CPC ..... *H05B 6/6447* (2013.01); *H05B 6/6455* (2013.01); *H05B 6/80* (2013.01)

(58) Field of Classification Search
USPC ..... 219/749, 754, 762, 685, 702, 704, 705, 219/707, 711, 714, 716
See application file for complete search history.

(56) References Cited

FOREIGN PATENT DOCUMENTS

| | | | | | |
|---|---|---|---|---|---|
| JP | 2005-140418 | | | 6/2005 | |
| JP | 2005140418 | A | * | 6/2005 | ..... H05B 6/6441 |
| WO | 2012/063135 | A2 | | 5/2012 | |
| WO | 2013/167948 | A2 | | 11/2013 | |
| WO | 2015/059931 | | | 4/2015 | |

OTHER PUBLICATIONS

International Search Report of PCT application No. PCT/JP2016/002641 dated Sep. 6, 2016.
The Extended European Search Report dated Jun. 27, 2018 for the related European Patent Application No. 16807088.6.

* cited by examiner

HEATING COOKER

This application is a U.S. national stage application of the PCT international application No. PCT/JP2016/002641.

TECHNICAL FIELD

The present invention relates to a heating cooker for heating foods.

BACKGROUND ART

A microwave oven, which is known as an example of a heating cooker, includes a plurality of heating sources such as oven heating, grill heating, and stream heating, as well as microwave heating. This type of heating cooker selects an appropriate heating source from a plurality of heating sources to heat foods. Accordingly, the heating cooker achieves a wide variety of types of cooking.

However, a complicated operation for setting control details of the selected heating source is required to handle a wide variety of types of cooking.

As a solution to this problem, there has been disclosed a technique which captures an image of a dish by using a camera provided on a microwave oven, and initiates cooking by using a cooking method corresponding to a dish registered beforehand (for example, see PTL 1).

There has been further disclosed a heating cooker that sets a finishing temperature different for each food, and issues video notification about a finishing status (for example, see PTL 2).

According to the technique described in PTL 1, however, images of dishes should be captured and registered beforehand. Accordingly, a user is required to perform a bothersome operation of this registration.

On the other hand, according to the technique described in PTL 2, a user is required to designate a food and set a temperature. More specifically, a user needs to touch a display image to designate a food, and press a temperature increase/decrease button to set a temperature. Accordingly, a user is required to perform a bothersome operation of this setting.

CITATION LIST

Patent Literature

PTL 1: Unexamined Japanese Patent Publication No. 2005-140418

PTL 2: Unexamined Japanese Patent Publication No. 2002-243166

SUMMARY OF THE INVENTION

According to the present invention, a user is allowed to easily input settings of respective heating control details in either case of a single food or a plurality of foods contained in a heating chamber. Moreover, when the food in the heating chamber is similar to a food for which heating control details have been previously set by the user, the corresponding heating control details are automatically read and presented. Accordingly, a heating cooker provided herein is an easy-to-use heating cooker capable of performing a heating process in accordance with preferences of the user.

More specifically, a heating cooker of the present invention includes a heating unit that heats a food stored in a heating chamber, an imaging unit that captures an image of a food or a dish contained in the heating chamber, a setting unit that sets heating control details of heating control performed by the heating unit, a storage that stores the image captured by the imaging unit and the heating control details set by the setting unit such that the image and the heating control details are associated with each other, a notification unit that issues notification about the heating control details, and a controller. The controller controls the notification unit such that the notification unit issues notification about the heating control details for the food or the dish present in the image captured by the imaging unit based on a number of the food or the dish.

According to this configuration, settings of respective heating control details are easily input when a single or a plurality of foods are contained and heated in the heating chamber. Moreover, when heating control details to be set correspond to heating control details which have been previously set by a user, the corresponding heating control details are automatically read and presented on the notification unit. Accordingly, an easy-to-use heating cooker capable of performing heating in accordance with preferences of the user can be realizable.

More specifically, when the user inputs normal settings of heating control details, and an instruction of heating start, an image of a food and heating control details are automatically associated with each other and stored in the storage as a correlation table. When a similar food is subsequently recognized from an image captured by the imaging unit such as a camera, desired heating control details are presented to the user in either case of a single food or a plurality of foods present within the heating chamber. Accordingly, an easy-to-use heating cooker can be provided.

DESCRIPTION OF EMBODIMENTS

Exemplary embodiments of the present invention are hereinafter described with reference to the drawings. The present invention is not limited to the exemplary embodiments presented herein.

First Exemplary Embodiment

A heating cooker according to a first exemplary embodiment of the present invention is hereinafter described with reference to FIG. 1.

Figure 1:
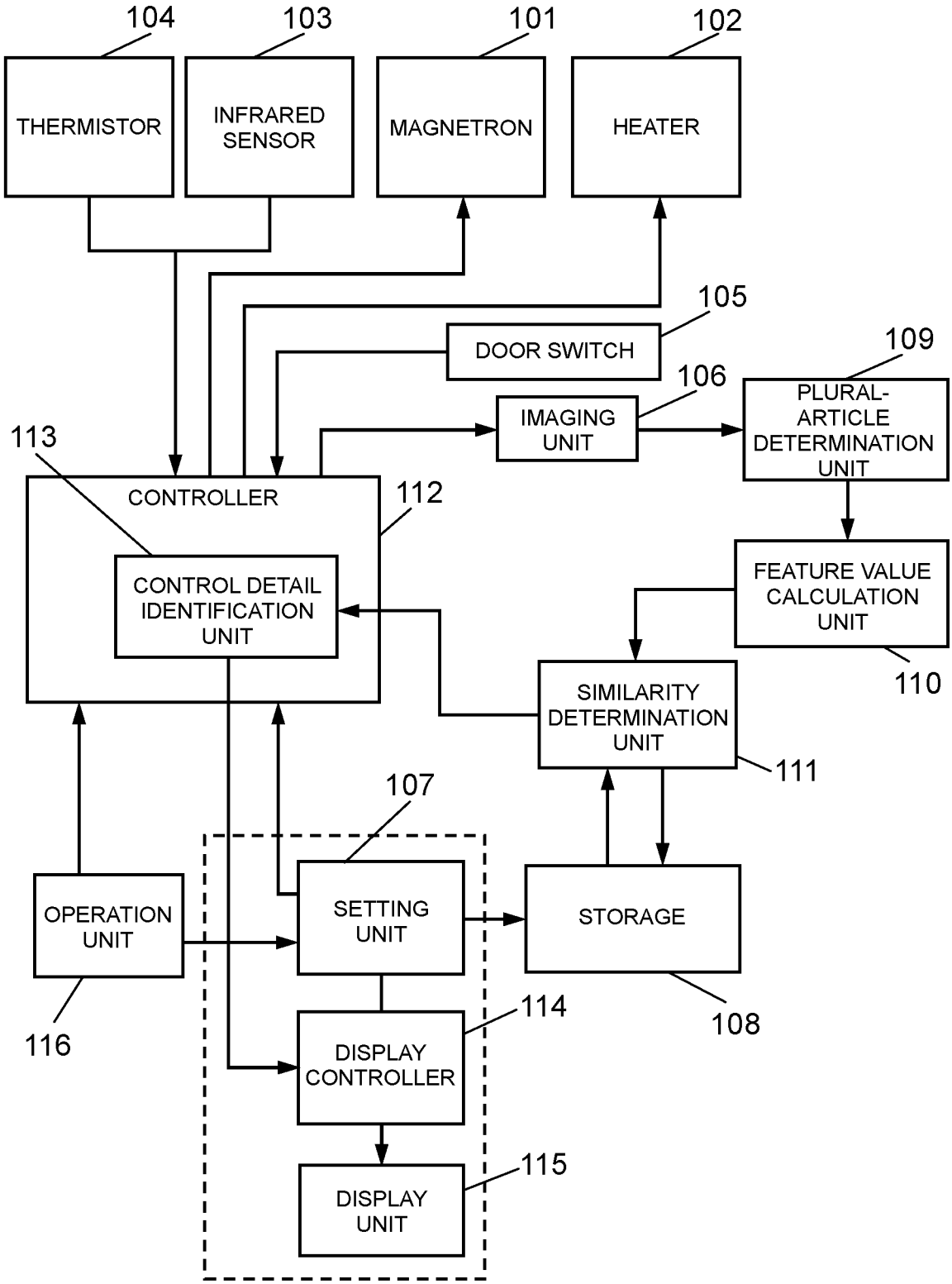
FIG. 1 is a block diagram illustrating a configuration of a heating cooker according to a first exemplary embodiment of the present invention.

FIG. 1 is a block diagram illustrating a configuration of the heating cooker according to the first exemplary embodiment of the present invention.

As illustrated in FIG. 1, the heating cooker according to the present exemplary embodiment includes magnetron 101, heater 102, infrared sensor 103, thermistor 104, door switch 105 constituting an opening/closing detector, imaging unit 106, setting unit 107, storage 108, plural-article determination unit 109, feature value calculation unit 110, similarity determination unit 111, controller 112 and others. Magnetron 101 and heater 102 constitute a heating unit that heats a food, for example. Infrared sensor 103 detects a temperature of a food. Thermistor 104 detects a temperature of an interior of a heating chamber. Door switch 105 detects opening or closing of a door inside the heating chamber. Imaging unit 106 is constituted by imaging elements such as charge coupled device (CCD), for example, to capture an image of the interior of the heating chamber. Setting unit 107 sets heating control details concerning heating control performed by the heating unit in accordance with a food or a dish, for example. Storage 108 is constituted by a non-volatile memory, such as a flash memory, to store heating control details associated with foods, for example. Plural-article determination unit 109 determines whether a plurality of foods is present inside the heating chamber. Feature value calculation unit 110 calculates a feature value of a food, a dish or the like based on an image captured by imaging unit 106. Similarity determination unit 111 calculates a degree of similarity of a food, a dish or the like based on an image captured by imaging unit 106.

Controller 112 controls the heating unit that heats a food, based on heating control details set by setting unit 107 while monitoring a temperature of a food detected by infrared sensor 103.

Controller 112 is constituted by a microprocessor, such as a central processing unit (a CPU), to control respective circuits as well as the heating unit.

Controller 112 further includes control detail identification unit 113. Control detail identification unit 113 identifies options of heating control for a food placed inside the heating chamber.

As illustrated in FIG. 1, the heating cooker includes display unit 115 corresponding to an example of a notification unit, display controller 114, operation unit 116 and others. Display unit 115 is constituted by a liquid crystal display device, for example, to display heating control details and others. Display controller 114 controls display of display unit 115. Operation unit 116 is constituted by a touch panel, a keyboard or the like to start heating and perform various types of operations in response to a touch or a pressing operation input to operation unit 116.

The heating cooker according to the present exemplary embodiment is configured as described above.

Operations and effects of the heating cooker having the above configuration are hereinafter described with reference to FIGS. 2 through 4.

Figure 2:
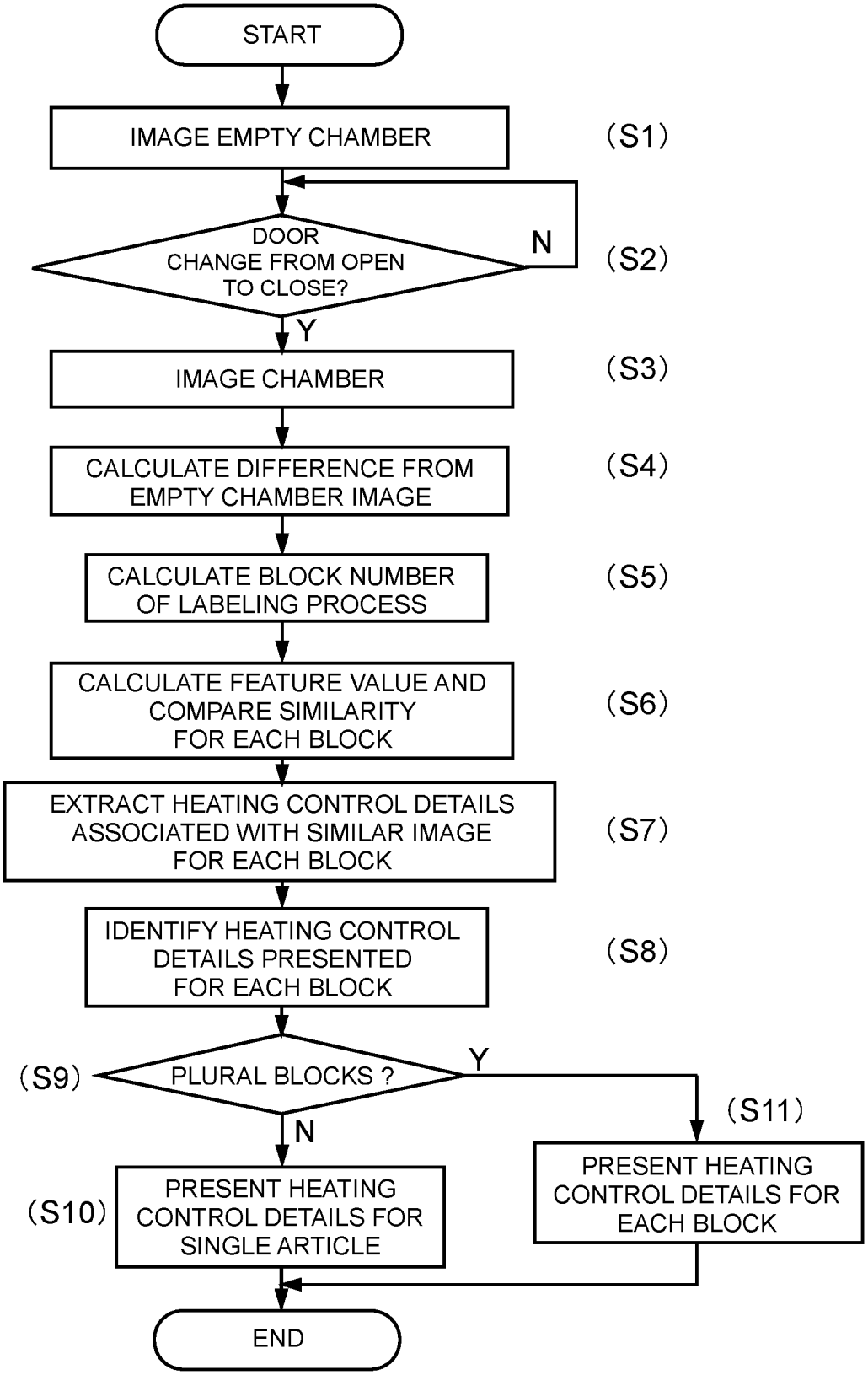
FIG. 2 is a flowchart illustrating an operation of the heating cooker according to the first exemplary embodiment.
Figure 3A:
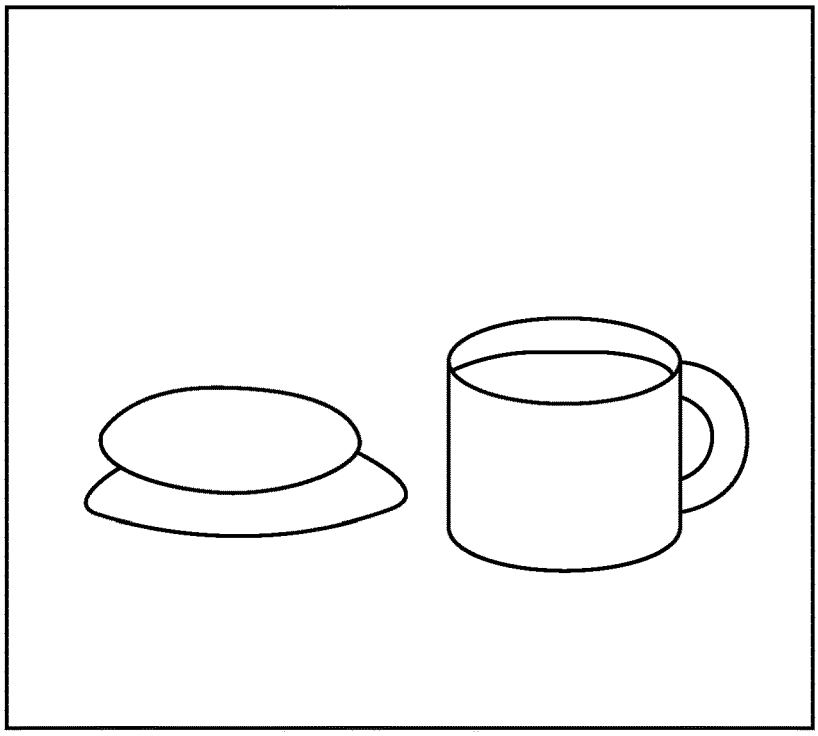
FIG. 3A is a view illustrating an example of a determination whether a plurality of types of foods are present in the heating cooker according to the first exemplary embodiment.
Figure 3B:
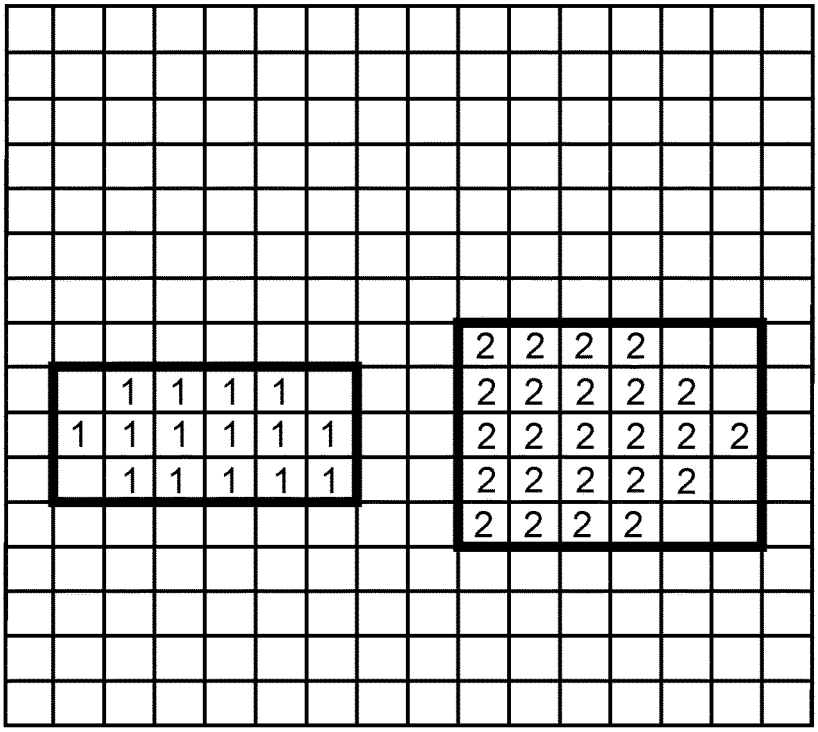
FIG. 3B is a view illustrating an example of a determination whether a plurality of types of foods are present in the heating cooker according to the first exemplary embodiment.

FIG. 2 is a flowchart illustrating an operation of the heating cooker. FIGS. 3A and 3B are views each illustrating an example of a determination whether a plurality of types of foods are present in the heating cooker. FIG. 4 is a flowchart illustrating an operation of the similarity determination unit of the heating cooker.

As illustrated in FIG. 2, controller 112 initially causes imaging unit 106 to capture an image of the interior of the heating chamber in response to supply of power of the heating cooker (step S1). Thereafter, image information about the captured image is stored in storage 108. Step S1 is a process for storing image information in storage 108 beforehand as information indicating an empty state inside the heating chamber.

Controller 112 subsequently determines whether the door has been opened or closed based on detection by door switch 105 constituting the opening/closing detector (step S2). When a state change of the door from an opened state to a closed state is not detected (N in step S2), the processing waits until the door state comes to the closed state.

On the other hand, when a determination is made that the door state has changed from the opened state to the closed state (Y in step S2), controller 112 causes imaging unit 106 to capture an image of the interior of the heating chamber (step S3). In this case, an image of the heating chamber containing a food and a dish is captured, for example, as illustrated in FIG. 3A.

Controller 112 subsequently transmits the captured image of the interior of the heating chamber to plural-article determination unit 109. Plural-article determination unit 109 calculates differences between the image of the interior of the empty heating chamber captured in step S1 and stored in the storage 108, and the image of the interior of the heating chamber captured in step S3, to binarize the calculated differences (step S4). More specifically, each of the images captured in step S1 and S3 is divided into a plurality of pixels. A luminance signal difference between the images is calculated for each pixel. The differences thus calculated are binarized.

Controller 112 subsequently causes similarity determination unit 111 to perform a labeling process for calculating a number of groups (hereinafter referred to as "blocks") (step S5). The labeling process is a process performed by similarity determination unit 111 to classify any pixel and a pixel near the pixel, give an identical number to continuous pixels each having a similar typical value, and handle a plurality of pixels given an identical number as one block as illustrated in FIG. 3B. Similarity determination unit 111 determines a number of blocks present in an image based on a result of the labeling process.

More specifically, similarity determination unit 111 initially compares luminance (or tint, for example) for each pixel of the image of the interior of the empty heating chamber captured beforehand, and of the image of the interior of the heating chamber currently captured, and quantifies a result of the comparison. Thereafter, similarity determination unit 111 determines pixels having an identical or a value within a predetermined range as continuous pixels.

In this case, plural-article determination unit 109 extracts a number of blocks in a predetermined size or larger from some blocks subjected to the labeling process. Assuming that a dish size is a size of a soy sauce dish or a child dish, for example, the predetermined size of a food block for a determination is set to a diameter of 5 cm or longer for a circular dish, or a side of 5 cm for a rectangular dish.

Feature value calculation unit 110 subsequently calculates a feature value for each block of pixels extracted as a food by plural-article determination unit 109. Similarity determination unit 111 subsequently compares a degree of similarity between the calculated feature value and a previous image stored in storage 108 (step S6).

The process performed in step S6 is more specifically described with reference to FIG. 4.

Figure 4:
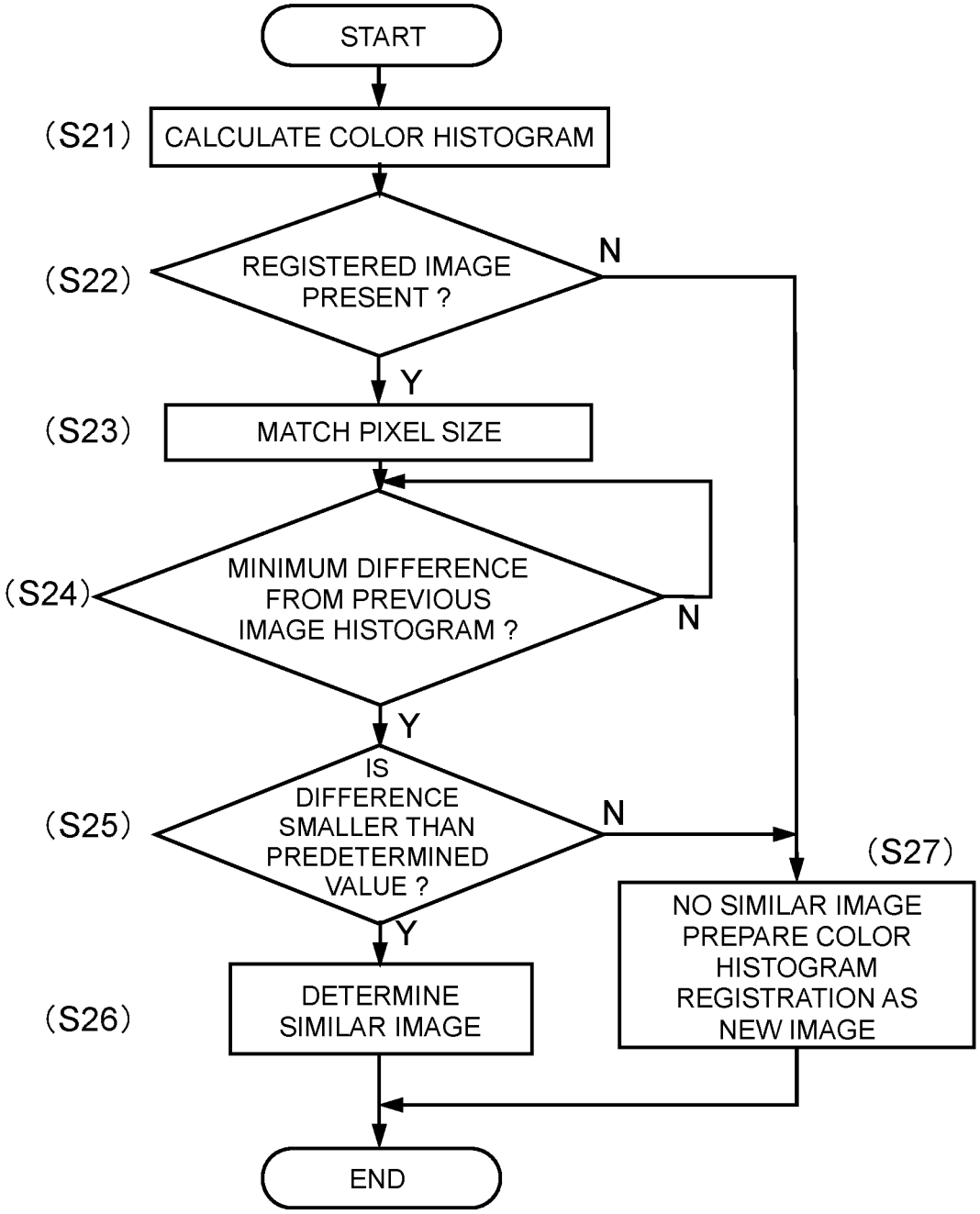
FIG. 4 is a flowchart illustrating an operation of a similarity determination unit of the heating cooker according to the first exemplary embodiment.

As illustrated in FIG. 4, controller 112 initially causes feature value calculation unit 110 to calculate brightness histograms of color signals (e.g., RGB signals) of respective pixels included in image information captured by imaging unit 106 (step S21).

Controller 112 subsequently determines whether storage 108 includes images registered beforehand (step S22). When no image is registered (N in step S22), a process in step S27 described below is executed.

On the other hand, when registered images are present (Y in step S22), controller 112 causes similarity determination unit 111 to convert a pixel size stored in storage 108 such that the pixel size in storage 108 becomes equivalent to a pixel size included in the image information currently captured in step S3 (step S23).

Similarity determination unit 111 subsequently calculates a difference between a sum of the histograms of the RGB signals of the respective pixels included in the image currently captured, and a sum of histograms of RGB signals of respective pixels included in one of the images stored in storage 108. Similarity determination unit 111 subsequently determines whether the difference becomes a minimum (step S24). When the difference is not the minimum (N in step S24), this determination is repeated by calculating a difference between the sum of the histograms of the RGB signals of the respective pixels included in the current image and a sum of histograms of RGB signals of respective pixels included in a different image stored in storage 108.

When the difference is the minimum (Y in step S24), similarity determination unit 111 determines whether the difference of the histograms of the extracted image is a predetermined value or smaller (step S25). When a determination is made that the difference is the predetermined value or larger (N in step S25), a process in step S27 described below is executed.

On the other hand, when a determination is made that the difference is smaller than the predetermined value (Y in step S25), controller 112 determines information about the image determined in step S24 as a similar image (step S26). Thereafter, the similarity comparison process performed by similarity determination unit 111 ends.

When no image is registered (N in step S22), and when the sum of the difference is smaller than the predetermined value or larger (N in step S25), controller 112 determines that a similar image is absent. Controller 112 subsequently displays a message "no similar image is registered", for example, on display unit 115. This notification informs a user about no registration of a similar image. Alternatively, controller 112 designates image information about the image currently captured as a new image, and registers the image in storage 108 together with the color histograms of a difference between the currently captured image and the initial image corresponding to a feature value (step S27). Thereafter, the similarity comparison process performed by similarity determination unit 111 ends.

The process for registering the new image described above is executed only when an instruction of heating start is issued via operation unit 116. In this case, the new image is registered in storage 108 in association with heating control details. Accordingly, when the door is opened without issue of an instruction of heating start via operation unit 116, registration of the new image in storage 108 is not executed.

The similarity comparison process in step S6 is performed in the manner described above by similarity determination unit 111.

Thereafter, as illustrated in FIG. 2, control detail identification unit 113 selects a similar image stored in storage 108 for each block by similarity determination unit 111. Control detail identification unit 113 further extracts and reads heating control details stored in storage 108 in associated with the selected similar image (step S7).

Control detail identification unit 113 subsequently identifies heating control details presented for each block (step S8). When similarity determination unit 111 determines that no similar image has been stored in storage 108, heating control details are not identified.

Controller 112 subsequently determines whether a plurality of blocks is included in the captured image information (step S9). When a plurality of blocks is not included (N in step S9), controller 112 performs a process for presenting heating control details for a single article corresponding to one block (step S10). More specifically, controller 112 causes display controller 114 to present, on display unit 115, heating control details for the single article identified in step S8. Thereafter, the processing ends.

On the other hand, when a plurality of blocks is included (Y in step S9), controller 112 performs a process for presenting heating control details for each of the plurality of blocks (step S11). More specifically, controller 112 causes display controller 114 to present, on display unit 115, a plurality of sets of heating control details determined in step S8. Thereafter, the processing ends.

As described above, a food and a dish contained in the heating chamber are presented on display unit 115 in association with corresponding heating control details based on a number of the food and the dish.

When the user subsequently issues an instruction of heating start via operation unit 116 in this state, controller 112 starts heating of the food and the dish contained in the heating chamber. In this case, temperatures such as the temperature of the interior of the chamber and the temperature of the food detected by thermistor 104 and infrared sensor 103 are monitored. Controller 112 heats the food, the dish and the like by using magnetron 101 and heater 102 constituting the heating unit based on the detected temperatures in accordance with the heating control details set by setting unit 107.

The heating cooker according to the present exemplary embodiment performs the heating operation in the manner described above.

An example of presentation on display unit 115 performed in steps S10 and S11 is hereinafter described with reference to FIG. 5.

Figure 5:
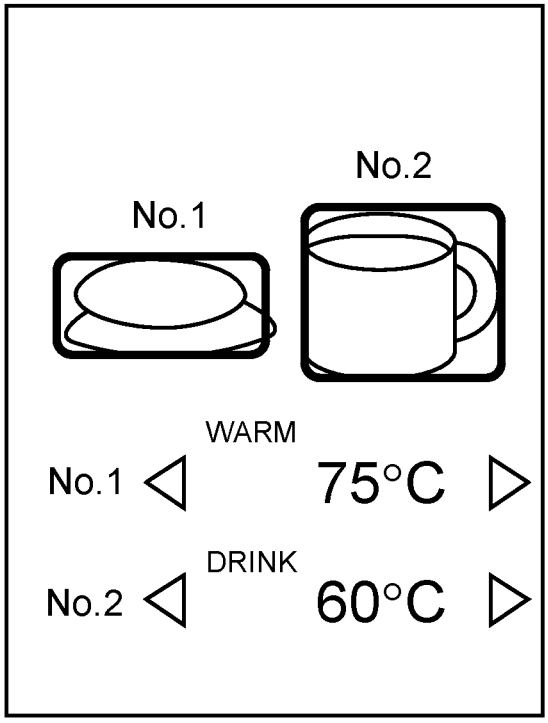
FIG. 5 is a view illustrating a presentation example of a display unit of the heating cooker according to the first exemplary embodiment.

As illustrated in FIG. 5, the food, the dish and the like extracted by plural-article determination unit 109 are cut into rectangular shapes, for example, and presented on display unit 115 for each block. Simultaneously, a menu, a target temperature and the like that are heating control details for the food, the dish and the like cut into the shapes are displayed on display unit 115. Accordingly, the user is capable of easily recognizing the heating control details associated with the food and the dish contained in the heating chamber. The user is also capable of freely adjusting the heating control details thus presented by an operation such as pressing a triangular indication provided on each of the left and right sides of a temperature indication.

Figure 6:
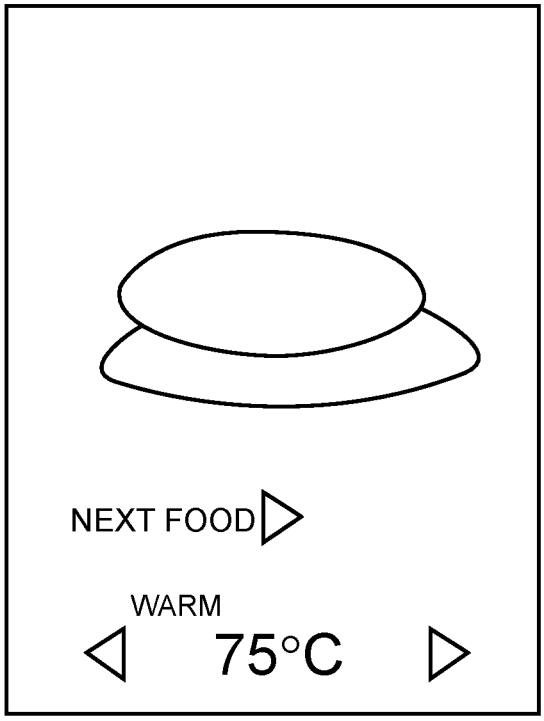
FIG. 6 is a view illustrating another presentation example of the display unit of the heating cooker according to the first exemplary embodiment.

According to the present exemplary embodiment described herein, all the plurality of foods and dishes present inside the heating chamber are presented as illustrated in FIG. 5. However, other configurations may be adopted. For example, as illustrated in FIG. 6, enlarged foods and dishes may be presented one by one for each block unit extracted by plural-article determination unit 109 by using a presentation mode selector switch, not illustrated. In addition, in either of the cases illustrated in FIGS. 5 and 6, an enlarged image of the selected target may be presented during setting by setting unit 107, for example. In this case, the user is capable of more easily recognizing heating control details.

According to the present exemplary embodiment, heating control details presented on display unit 115 may be retained without change when an instruction of heating start is issued from operation unit 116. More specifically, information about feature values of images and heating control details stored in storage 108 need not be changed. In this case, the user is not required to set heating control details to start heating by the heating cooker.

According to the present exemplary embodiment, heating control details may be changed by setting unit 107 when heating control details are not presented on display unit 115. For example, heating control details to be presented are freely adjustable based on an operation such as pressing the triangular indication provided on each of the left and right sides of the temperature indication. When an instruction of heating start is issued via operation unit 116 in this state, controller 112 may register a feature value of a corresponding image and changed heating control details in storage 108 in association with each other as new registration. In this case, the heating control details are displayed on display unit 115 when the same food or dish is heated next time.

According to the present exemplary embodiment, feature values of images and heating control details stored in storage 108 may be updated in accordance with a change of presented heating control details input from the user to setting unit 107 via operation unit 116. In this case, more appropriate heating control details can be displayed on display unit 115 when the same food or dish is heated next time.

According to the present exemplary embodiment, information stored in storage 108 may be deleted together with corresponding heating control details after an elapse of time from the time of storage into storage 108. In this case, an increase in a memory capacity can be suppressed. Information which has not been subject to updating or new registration is preferably deleted from the oldest information in accordance with a registration capacity of information.

According to the present exemplary embodiment, image information is stored in storage 108 in association with information about corresponding images together with feature values of the images. This configuration allows checking of images at a later time. However, only feature values may be stored, for example.

According to the present exemplary embodiment, feature values of images stored in storage 108 are not changed when an instruction of heating start is issued via operation unit 116. However, other configurations may be adopted. For example, feature values of images may be updated to latest feature values, or may be updated by averaging feature values. In this case, more appropriate heating control details can be displayed on display unit 115 when the same food or dish is heated next time.

According to the present exemplary embodiment described by way of example, an image is captured beforehand by imaging unit 106 at the time when a power source of the heating cooker is turned on. However, other configurations may be adopted. For example, an image may be captured at any time as long as the heating chamber is empty.

According to the present exemplary embodiment, a new image is registered in storage 108 under following conditions regardless of the determination of presence or absence of plural articles by plural-article determination unit 109. More specifically, a new image is registered when no image is registered in storage 108, or when a difference between a new image and a registered image is a predetermined value or larger under issue of a heating instruction. However, a new image may be registered under other conditions. For example, a new image may be registered when plural-article determination unit 109 determines that only a single article (one food) is present under issue of a heating instruction. In this case, more appropriate heating control details for a single article can be registered.

According to the present exemplary embodiment described by way of example, heating control details are not displayed on display unit 115 when heating control details identified by control detail identification unit 113 are absent. However, other configurations may be adopted. For example, default heating control details prepared beforehand may be displayed. In this case, the user is capable of easily inputting settings of heating control details.

According to the present exemplary embodiment described by way of example, information registered in storage unit 108 is deleted from the oldest information that has not been subject to updating or new registration with an elapse of time from registration. However, other configurations may be adopted. For example, the user may read any registration image to designate the image as a deletion target, and deletes the designated image. In this case, an increase in a memory capacity can be suppressed.

According to the present exemplary embodiment described by way of example, the notification unit is constituted by display unit 115. However, other configurations may be adopted. For example, the notification unit may be constituted by a voice generator including an audio synthesis device for notification through voices. In this case, even a visually impaired user is capable of easily inputting settings of heating control details.

According to the present exemplary embodiment described by way of example, plural-article determination unit 109, feature value calculation unit 110, similarity determination unit 111, controller 112, control detail identification unit 113, display controller 114 and other components configured individually. However, other configurations may be adopted. For example, functions of the respective constituent elements described above may be incorporated into one controller to be execute by the controller into which the respective functions are incorporated. In this case, cost reduction of the heating cooker is achievable.

As described above, the heating cooker according to the present exemplary embodiment includes the heating chamber to which the openable and closable door is attached, magnetron 101 and heater 102 constituting the heating unit that heats a food stored in the heating chamber, imaging unit 106 that captures an image of the interior of the heating chamber, setting unit 107 that sets heating control details, and storage 108 that stores the image captured by imaging unit 106 and the heating control details set by setting unit 107 such that the image and the heating control details are associated with each other. The heating cooker further includes plural-article determination unit 109 that determines whether a plurality of types of foods are present, similarity determination unit 111 that determines a degree of similarity of a plurality of images captured by imaging unit 106, control detail identification unit 113 that identifies heating control details corresponding to a food included in an image captured by imaging unit 106 in accordance with a determination result obtained by similarity determination unit 111, display unit 115 that presents heating control details; and controller 112. When plural-article determination unit 109 determines that a single food is present, controller 112 presents a single set of heating control details on display unit 115. When plural-article determination unit 109 determines that a plurality of types of foods are present, controller 112 presents a plurality of sets of heating control details on display unit 115 for each type of the foods. According to this configuration, respective settings including respective heating control details are easily input when a single or a plurality of foods is contained in the heating chamber. Moreover, when the food or the like currently determined corresponds to a food or the like for which heating control details or the like have been previously set by the user during daily operations unconsciously performed by the user, the corresponding heating control details are automatically read and presented. Accordingly, an easy-to-use heating cooker capable of performing heating in accordance with preferences of the user can be realizable.

Furthermore, when plural-article determination unit 109 determines that a plurality of types of foods are present in the heating cooker according to the present exemplary embodiment, controller 112 divides an image including a plurality of foods and captured by imaging unit 106 into partial images each including corresponding one of the plurality of foods, and presents the divided partial images on display unit 115. In this case, the respective divided partial images are presented without change or as enlarged images. Simultaneously, corresponding heating control details are presented on display unit 115 for each of the divided partial images. In this case, the user is capable of more easily recognizing the respective foods present in the heating chamber even when a plurality of foods is contained in the heating chamber. Accordingly, the heating cooker realized herein further facilitates respective settings including heating control details.

Second Exemplary Embodiment

A heating cooker according to a second exemplary embodiment of the present invention is hereinafter described with reference to FIGS. 7 and 8.

Figure 7:
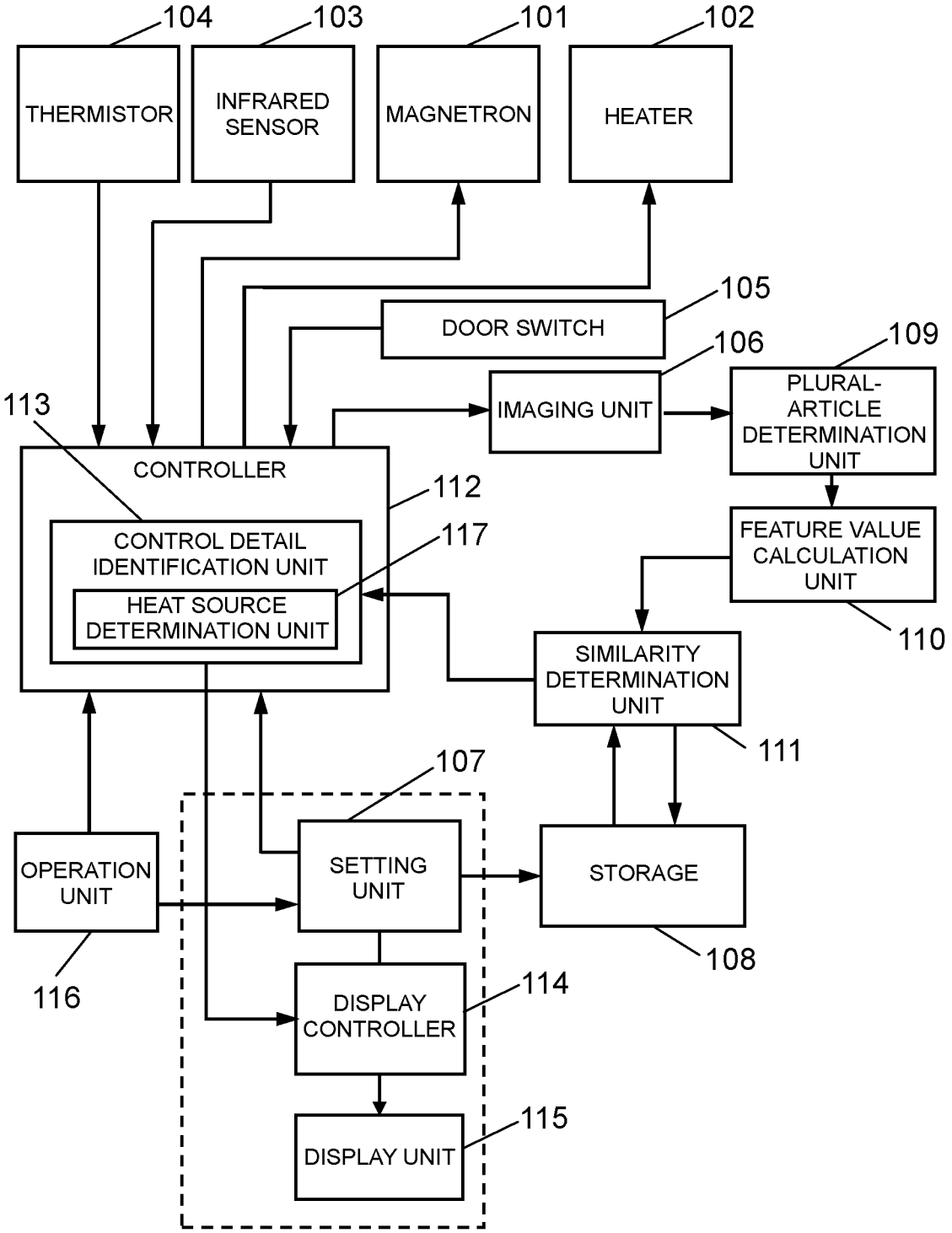
FIG. 7 is a block diagram illustrating a configuration of a device according to a second exemplary embodiment of the present invention.

FIG. 7 is a block diagram illustrating a configuration of the heating cooker according to the second exemplary embodiment of the present invention. FIG. 8 is a flowchart illustrating an operation of the heating cooker.

More specifically, the heating cooker according to the present exemplary embodiment is different from the heating cooker according to the first exemplary embodiment in that control detail identification unit 113 further includes heat source determination unit 117 as illustrated in FIG. 7. Other constituent elements are similar to the corresponding elements of the first exemplary embodiment, and are given identical reference numbers and identical names. Accordingly, detailed description of these constituent elements is not repeated herein.

The heating cooker according to the present exemplary embodiment in configured so that heat source determination unit 117 determines a predetermined heating source and heats a food based on heating control details extracted in association with foods and dishes.

The heating cooker according to the present exemplary embodiment is configured as described above.

Operations and effects of the heating cooker having the configuration described above are hereinafter described with reference to FIG. 8.

Initially, an image of an empty state of the interior of the heating chamber is captured beforehand. Thereafter, the door is closed with foods or the like stored in the heating chamber, and an image of the interior of the heating chamber is again captured by the imaging unit. Control detail identification unit 113 subsequently extracts heating control details associated with similar images for each block. The foregoing operations are similar to the corresponding operations of the first exemplary embodiment described with reference to FIG. 2.

In other words, the operations in steps S1 through S7 illustrated in FIG. 2 are initially performed similarly to the first exemplary embodiment.

Figure 8:
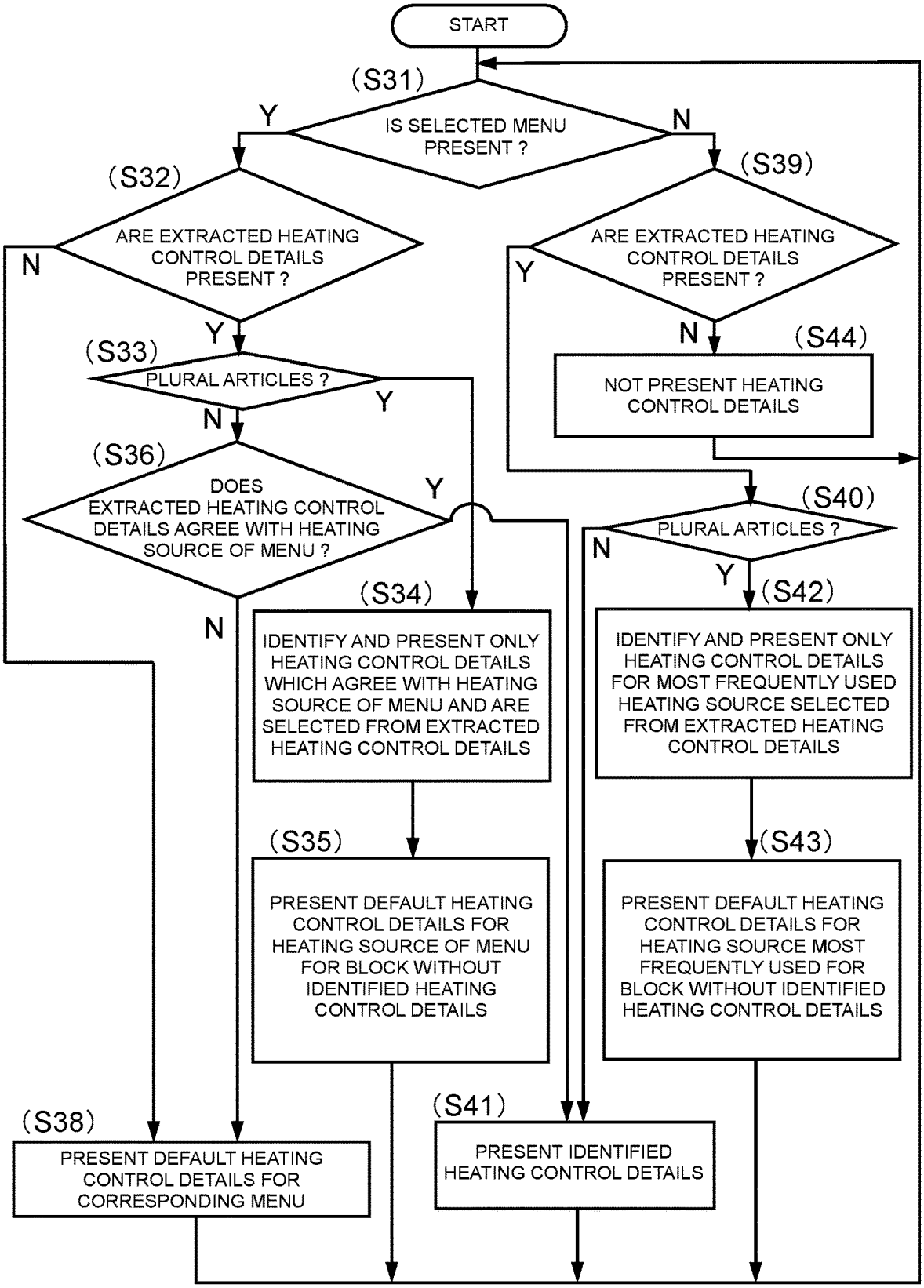
FIG. 8 is a flowchart illustrating an operation of the heating cooker according to the second exemplary embodiment.

Thereafter, operations in steps S31 through S43 illustrated in FIG. 8 and corresponding to features of the present exemplary embodiment are performed. Accordingly, description of the operations performed in steps S1 through S7 in FIG. 2 is not repeated.

The operation of the heating cooker according to the second exemplary embodiment is specifically described with reference to FIG. 8.

As illustrated in FIG. 8, control detail identification unit 113 initially determines whether setting details set by setting unit 107, such as a selected menu, are present (step S31). The setting details are not limited to details of determined settings, but include heating control details associated with a use heating source selected in a middle of setting. When the selected menu is present (Y in step S31), the processing proceeds to step S32. More specifically, the determination is made that the selected menu is present when a menu "warm" is selected, or when the menu "warm" is selected beforehand as a default menu, for example.

Control detail identification unit 113 of controller 112 subsequently determines whether heating control details are stored in storage 108 in association with the extracted image (step S32). When extracted heating control details are present (Y in step S32), plural-article determination unit 109 determines whether a plurality of types of foods (plural articles) are present (step S33).

When the determination is made that only a single article is present in this step (N in step S33), heat source determination unit 117 determines whether a heating source of the extracted heating control details agrees with a heating source of the menu (step S36). In other words, heat source determination unit 117 determines whether the heating source used for "warm" of the selected menu agrees with the heating source of the heating control details associated with the extracted similar image. More specifically, agreement is determined in a state that the heating source of the menu is only magnetron 101, and that the heating source of the extracted heating control details is only magnetron 101 for heating control. That is, the extracted heating control details are identified as heating control details for the corresponding block when the heating source of the heating control details agrees with the heating source of the menu (Y in step S36). Thereafter, controller 112 transmits information about the identified heating control details to display controller 114 to present the information on display unit 115 (step S41). The processing then returns to step S31 and similar processing is executed.

On the other hand, when the heating source of the heating control details associated with the extracted similar image does not agree with the heating source of the menu (N in step S36), default heating control details of the menu are presented on display unit 115 for the block exhibiting disagreement of the heating source (step S38). More specifically, display unit 115 displays, as heating control details for the block, corresponding heating control details (e.g., fixed target temperature and heating time, or previously used target temperature and heating time that are default heating control details of selected "warm" menu) on display unit 115. The processing then returns to step S31 and similar processing is executed.

When plural-article determination unit 109 determines that a plurality of types of foods (plural articles) are present in step 33 (Y in step S33), control detail identification unit 113 selects the heating source of the heating control details agreeing with the heating source of the determined menu from the respective heating sources of the extracted heating control details based on the determination of heat source determination unit 117 (step S34). More specifically, only the heating source of the heating control details indicating only magnetron 101 for heating control is selected as the heating control details for the corresponding block from the respective heating sources of the heating control details associated with the similar images for each extracted block. Thereafter, information about the identified heating control details are transmitted to display controller 114 to be presented on the display unit 115.

In this case, default heating control details for the heating source of the menu are presented on display unit 115 for a block for which heating control details are not identified in step S34 (step S35). More specifically, corresponding default heating control details (e.g., fixed target temperature and heating time, or target temperature and heating time previously used which are default heating control details for selected "warm" menu) are displayed on display unit 115 as heating control details for the corresponding block. Thereafter, the processing returns to step S31 and processes in and after step S31 are executed.

Similarly, when the heating source used for the selected menu determined by heat source determination unit 117 is only heater 102, for example, included in the heating sources identified for the heating control details associated with the similar images for each extracted block, control detail identification unit 113 identifies only heater 102 for heating control as the heating source of the heating control details. On the other hand, when the use heating source determined by heat source determination unit 117 is constituted by magnetron 101 and heater 102, the heating source constituted by magnetron 101 and heater 102 for heating control of the heating control details is identified as the heating control details for the corresponding block. Thereafter, information about the identified heating control details are transmitted to display controller 114 to be presented on the display unit 115.

More specifically, when plural-article determination unit 109 determines that only a single food is present in step S33 (N in step S33), control detail identification unit 113 identifies only the heating source which is included in the single set of heating control details and agrees with the use heating source determined by heat source determination unit 117 as the heating control details for the corresponding block, and transmits information indicating the identified heating source to display controller 114. On the other hand, when plural-article determination unit 109 determines that a plurality of foods (plural articles) is present (Y in step S33), the heating sources, which are included in all the plurality of sets of heating control details and agree with the use heating sources determined by heat source determination unit 117, are identified as the heating control contents for the corresponding blocks. Thereafter, information indicating the identified heating sources is transmitted to display controller 114.

Control detail identification unit 113 narrows information based on the use heating source determined by heat source determination unit 117 every time details concerning the heating source in the selected heating control details are changed until determination of settings by setting unit 107. Thereafter, the narrowed information is transmitted to display controller 114.

When heating control details stored in storage 108 in association with images are not extracted by control detail identification unit 113 in step S32 (N in step S32), default heating control details for the corresponding menu are presented on display unit 115 for the block not extracted (step S38). More specifically, corresponding default heating control details (e.g., fixed target temperature and heating time, or target temperature and heating time previously used as default heating control details for selected "warm" menu) are displayed on display unit 115. The processing then returns to step S31 and similar processing is executed.

On the other hand, when control detail identification unit 113 determines that setting details set by setting unit 107, such as a selected menu, are not present in step S31 (N in step S31), control detail identification unit 113 determines whether heating control details associated with similar images are present for each extracted block (step S39). When extracted heating control details are present (Y in S39), plural-article determination unit 109 determines whether a plurality of types of foods (plural articles) are present (step S40).

When a determination is made that only a single food is preset in this step (N in step S40), controller 112 transmits information about the extracted heating control details to display controller 114 as identified heating control details to present the information on display unit 115 (step S41).

On the other hand, when the determination is made that a plurality of foods is present (Y in step S40), control detail identification unit 113 checks all the use heating sources included in the plurality of sets of heating control details extracted to be associated based on the determination by heat source determination unit 117. Thereafter, control detail identification unit 113 identifies heating control details only for a block associated with heating control details indicating a use heating source most frequently used. Information indicating the identified heating control details is transmitted to display controller 114 to be presented on display unit 115 (step S42).

In this case, default heating control details indicating a use heating source most frequently used are presented on display unit 115 for a block for which heating control details are not identified in step S42 (step S43). The processing then returns to step S31 and similar processing is executed.

When heating control details associated with similar images are absent for each extracted block in step S39 (N in step S39), controller 112 does not transmit information to display controller 114, and therefore does not display the information on display unit 115 (step S44). The processing then returns to step S31 and similar processing is executed.

Control detail identification unit 113 narrows identified information based on the use heating source determined by heat source determination unit 117 every time details concerning the heating source in the selected heating control details are changed until determination of settings by setting unit 107. The narrowed information is transmitted to display controller 114 similarly to the case where the selected menu is present.

In a state that a number of blocks determined by plural-article determination unit 109 is an even number, and that a number of blocks indicating an identical use heating source determined by heat source determination unit 117 is identical to a number of blocks indicating another identical use heating source determined by heat source determination unit 117 in step S42, heating control details indicating the use heating source belonging to the block in the largest size of the image divided by plural-article determination unit 109 are identified. Thereafter, information about heating control details of the identified block is transmitted to display controller 114. When neither of the foregoing cases is applicable, information is not transmitted to display controller 114, and not displayed on display unit 115.

As described above, control detail identification unit 113 of the heating cooker according to the present exemplary embodiment includes heat source determination unit 117.

Display unit 115 presents only heating control details identified and selected beforehand by control detail identification unit 113, or heating control details including a heating source which agrees with a heating source selected by setting unit 107. Accordingly, heating control details which indicate settings suited for intention of the user and achieve heating more rapidly can be presented.

In addition, a following operation is performed when plural-article determination unit 109 determines that a plurality of types of foods are present based on image information captured by imaging unit 106 in a state that heating control details identified by control detail identification unit 113 for the plurality of types indicate different heating sources for each type.

When a heating source included in heating control details selected beforehand, or in heating control details selected by setting unit 107 is absent under the foregoing situation, display unit 115 presents only heating control details including a heating source most frequently used in the identified control details. Accordingly heating control details which indicate settings suited for intention of the user, and achieve heating more rapidly can be presented in accordance with foods contained in the heating chamber.

Furthermore, a following operation is performed when plural-article determination unit 109 determines that a plurality of types of foods are present based on food image information captured by imaging unit 106 in a state that heating control details identified by control detail identification unit 113 for the plurality of types indicate different heating sources for each type.

When a heating source included in heating control details selected beforehand, or in heating control details selected by the setting unit is absent under the foregoing situation, display unit 115 displays only the heating control details included in the identified heating control details and associated with a partial image in a largest image size in partial images divided by plural-article determination unit 109. Accordingly, heating control details which indicate settings suited for intention of the user, and achieve heating more rapidly can be presented in accordance with foods contained in the heating chamber.

According to the present exemplary embodiment described by way of example, heating control details including a use heating source selected by setting unit 107 are displayed as a menu. However, other configurations may be adopted. For example, any heating control details may be displayed as long as a use heating source such as "microwave" and "grill" is directly designated by heating control details.

According to the present exemplary embodiment described herein, plural-article determination unit 109, feature value calculation unit 110, similarity determination unit 111, controller 112, control detail identification unit 113, display controller 114 and other components have individual configurations and names. However, other configurations may be adopted. For example, functions of the respective constituent elements described above may be incorporated into one controller to be execute by the controller into which the respective functions are incorporated. In addition, all the foregoing constituent elements and circuits may be collectively referred to as the controller.

As described above, a heating cooker of the present invention includes: a heating unit that heats a food stored in a heating chamber; an imaging unit that captures an image of a food or a dish contained in the heating chamber; a setting unit that sets heating control details of heating control performed by the heating unit; a storage that stores the image captured by the imaging unit and the heating control details set by the setting unit such that the image and the heating control details are associated with each other; a notification unit that issues notification about the heating control details; and a controller. The controller may be configured to control the notification unit such that the notification unit issues notification about the heating control details for the food or the dish present in the image captured by the imaging unit based on a number of the food or the dish.

According to this configuration, settings of respective heating control details are easily input when a single or a plurality of foods are contained and heated in the heating chamber. Moreover, when heating control details to be set correspond to heating control details which have been previously set by a user, the corresponding heating control details are automatically read and presented on the notification unit. Accordingly, an easy-to-use heating cooker capable of performing heating in accordance with preferences of the user can be realizable.

The heating cooker of the present invention includes the heating chamber that includes an openable door, and an opening/closing detector that detects opening or closing of the door. The controller causes the imaging unit to capture an image of the food or the dish contained in the heating chamber when the opening/closing detector detects that a state of the door has changed from an opened state to a closed state, and compares the image captured by the imaging unit and showing the food or the dish contained in the heating chamber, and the image stored in the storage. The controller may be configured to control the notification unit such that the notification unit issues notification about the heating control details for the food or the dish present in the image captured by the imaging unit based on the number of the food or the dish.

According to this configuration, the user is capable of more easily recognizing respective foods present in the heating chamber even when a plurality of foods is contained and heated in the heating chamber. Accordingly, the user is capable of easily inputting settings of respective heating control details.

The notification unit of the heating cooker of the present invention may include a display unit. At a time of determination that the image captured by the imaging unit includes a plurality of types of the foods or the dishes, the controller may divide the image captured by the imaging unit into a plurality of partial images each including a corresponding one of the foods or dishes present in the image captured by the imaging unit. In this case, the controller may display the divided partial images on the display unit without change or as individually enlarged partial images, and display corresponding heating control details for each displayed partial image.

Accordingly, heating control details which indicate settings suited for intention of the user, and achieve heating more rapidly can be presented in accordance with foods contained in the heating chamber.

When the image captured by the imaging unit of the heating cooker of the present invention includes the food or the dish, the controller may extract the heating control details corresponding to the food or the dish included in the image. When a heating source corresponding to the extracted heating control details agrees with a heating source corresponding to the heating control details set by the setting unit, the controller may cause the notification unit to issue notification about the heating control details.

Accordingly, the heating control details present settings suited for intention of the user, and achieve heating more rapidly in accordance with the foods contained in the heating chamber.

When the image captured by the imaging unit of the heating cooker of the present invention includes a plurality of the foods or the dishes, the controller extracts a plurality of sets of the heating control details corresponding to the plurality of foods or dishes included in the image. At a time of determination that heating sources corresponding to the plurality of sets of extracted heating control details are different from each other, or that a heating source corresponding to the heating control details set by the setting unit beforehand is absent, the controller may cause the notification unit to issue notification about only the heating source most frequently used in the heating sources corresponding to the plurality of sets of extracted heating control details.

Accordingly, the heating control details present settings suited for intention of the user, and achieve heating more rapidly in accordance with the foods contained in the heating chamber.

When the determination is made that a plurality of types of foods are present based on an image captured by the imaging unit of the heating cooker of the present invention, the controller determines heating control details and heating sources corresponding to the foods included in the captured image. When the determined heating sources are different for each of the foods, or when a heating source included in the heating control details set by the setting unit beforehand is different from the heating sources corresponding to the captured image, the notification unit may be configured to present only the heating control details associated with the heating control details for a partial image in a largest image size in the respective sets of heating control details set for the heating cooker.

Accordingly, the heating cooker provided herein presents heating control details indicating settings suited for intention of the user more rapidly in accordance with the foods contained in the heating chamber.

INDUSTRIAL APPLICABILITY

A heating cooker of the present invention facilitates setting of respective heating control details for a single or a plurality of foods contained in the heating chamber. Moreover, when the food in the heating chamber is similar to a food for which heating control details have been previously set, the corresponding heating control details are automatically read and presented. Accordingly, the heating cooker of the present invention is useful not only for home use, but also for business use.

The invention claimed is:

1. A heating cooker comprising:

a heating unit that heats a food stored in a heating chamber;

an imaging unit that captures an image of a food or a dish contained in the heating chamber;

a setting unit that sets heating control details of heating control performed by the heating unit;

a storage that stores the image captured by the imaging unit and the heating control details set by the setting unit such that the image and the heating control details are associated with each other;

a notification unit that issues notification about the heating control details; and a controller, wherein the controller compares the image of the food or the dish contained in the heating chamber, and a reference image of an empty heating chamber, wherein the reference image is captured beforehand, and the controller controls the notification unit such that the notification unit issues notification about the heating control details for the food or the dish present in the image captured by the imaging unit based on a number of the food or the dish.

2. The heating cooker according to claim 1, further comprising:

the heating chamber that includes an openable door; and an opening/closing detector that detects opening or closing of the door, wherein the controller causes the imaging unit to capture an image of the food or the dish contained in the heating chamber when the opening/closing detector detects that a state of the door has changed from an opened state to a closed state.

3. The heating cooker according to claim 1, wherein the notification unit includes a display unit, when a determination is made that the image captured by the imaging unit includes a plurality of types of the foods or the dishes, the controller divides the image captured by the imaging unit into a plurality of partial images each including a corresponding one of the foods or dishes present in the image captured by the imaging unit, and displays the divided partial images on the display unit without change or as individually enlarged partial images, and the controller displays the corresponding heating control details for each of the displayed partial images.

4. The heating cooker according to claim 1, wherein when the image captured by the imaging unit includes the food or the dish, the controller extracts the heating control details corresponding to the food or the dish included in the image, and when a heating source corresponding to the extracted heating control details agrees with a heating source corresponding to the heating control details set by the setting unit, the controller causes the notification unit to issue notification about the heating control details.

5. The heating cooker according to claim 1, wherein when the image captured by the imaging unit includes a plurality of the foods or the dishes, the controller extracts a plurality of sets of the heating control details corresponding to the plurality of foods or dishes included in the image, and when a determination is made that heating sources corresponding to the plurality of sets of the extracted heating control details are different from each other, or that a heating source corresponding to the heating control details set by the setting unit beforehand is absent, the controller causes the notification unit to issue notification about only the heating source most frequently used in the heating sources corresponding to the plurality of sets of the extracted heating control details.

6. The heating cooker according to claim 1, wherein when a determination is made that a plurality of types of the foods are present based on the image captured by the imaging unit, the controller determines sets of the heating control details and heating sources corresponding to the foods in the captured image, and when the determined heating sources are different for each of the foods, or when a heating source included in the heating control details set by the setting unit beforehand is different from the heating sources corresponding to the captured image, the notification unit presents only the heating control details associated with the heating control details for a partial image in a largest image size in the respective sets of heating control details set for the heating cooker.

7. The heating cooker according to claim 1, wherein:

the heating unit includes a plurality of different heating sources, and the controller is configured to determine a predetermined heating source from the plurality of different heating sources based on the heating control details.

8. The heating cooker according to claim 7, wherein:

the plurality of different heating sources includes a magnetron and a heater.

9. The heating cooker according to claim 1, further comprising an infrared sensor for detecting a temperature of the food, wherein:

the controller controls the heating unit that heats a food, based on the heating control details set by the setting unit while monitoring a temperature of the food detected by the infrared sensor.

* * * * *